US006835018B2

(12) United States Patent
Miczewski et al.

(10) Patent No.: US 6,835,018 B2
(45) Date of Patent: Dec. 28, 2004

(54) PACKAGED HAIR COLOR COMPOSITION AND METHOD FOR COLORING HAIR

(75) Inventors: Melissa Jamie Miczewski, Rahway, NJ (US); Maxine Gayle Moore, Piscataway, NJ (US); Glenn Robert Geardino, Red Bank, NJ (US); Manharbhai Kantibhai Patel, Saddlebrook, NJ (US); Lou Ann Christine Vena, Scotch Plains, NJ (US); Barry Hutton, Northumberland (GB); Michael Corcoran, Northumberland (GB); William Heron, Newcastle upon Tyne (GB); Leo Clifford Pires, Basking Ridge, NJ (US)

(73) Assignee: Revlon Consumer Products Corporation, New York, NY (US)

( * ) Notice: Subject to any disclaimer, the term of this patent is extended or adjusted under 35 U.S.C. 154(b) by 0 days.

(21) Appl. No.: 10/238,670

(22) Filed: Sep. 10, 2002

(65) Prior Publication Data

US 2004/0047672 A1 Mar. 11, 2004

(51) Int. Cl.[7] ..... B43M 11/06

(52) U.S. Cl. ..... 401/196; 401/202

(58) Field of Search ..... 401/196, 202, 401/205, 206; 8/431, 405, 466

(56) References Cited

U.S. PATENT DOCUMENTS

| | | | | |
|---|---|---|---|---|
| 2,034,137 A | | 3/1936 | Fitzgibbon | 15/565 |
| 2,716,250 A | | 8/1955 | Deakers | 15/143 |
| 2,853,728 A | | 9/1958 | Nadai | 15/134 |
| 3,036,328 A | | 5/1962 | Schach | 15/572 |
| 3,054,133 A | | 9/1962 | Hublard | 15/565 |
| 3,072,953 A | | 1/1963 | Bunke | 15/592 |
| 3,106,742 A | | 10/1963 | Schultz | 15/565 |
| 3,108,314 A | | 10/1963 | House | 14/566 |
| 3,121,906 A | | 2/1964 | Hulsh | 15/592 |
| 3,132,370 A | | 5/1964 | Capezzuto | 15/541 |
| 3,135,007 A | | 6/1964 | Howell | 15/608 |
| 3,261,515 A | | 7/1966 | Luedtke | 222/520 |
| 3,756,732 A | | 9/1973 | Stoffler | 401/202 |
| 3,930,792 A | * | 1/1976 | Alperin et al. | 8/415 |
| 4,752,147 A | | 6/1988 | Persi | 401/126 |
| 4,931,066 A | * | 6/1990 | Grollier et al. | 8/410 |

(List continued on next page.)

FOREIGN PATENT DOCUMENTS

| | | |
|---|---|---|
| EP | 312343 | 4/1989 |
| JP | 1166705 | 6/1989 |

OTHER PUBLICATIONS

Journal of Society of Cosmetic Chemistry, vol. 36, pp. 1–16 (Jan./Feb.). Diffusion of Semipermanent Dyestuffs in Human Hair.

Clairol Loving Care, Color Crème Hair Color, Medium Brown, No. 765, package copy, circa Jan., 2000.

Revlon Professional, Cool Hue, Semi–Permanent Hair Color, package copy, circa Aug., 1989.

African Pride, AP–105, HiLites Color Boost, Semi–Permanent Color Enhancers, circa Jan. 2000.

Clairol XtremeFX, Color Shock, circa Jan. 2000.

Research Disclosure No. 452082, Dec. 2001. Hair Color Compositions.

*Primary Examiner*—Gregory L. Huson
*Assistant Examiner*—Huyen Le
(74) *Attorney, Agent, or Firm*—Julie Blackburn

(57) ABSTRACT

A packaged hair color composition comprising a flowable aqueous semi-permanent hair dye composition contained in a container having a porous dispensing outlet which is operable to express the flowable aqueous hair dye composition onto the hair to be colored, a method for coloring hair, a method for touching up hair color between oxidative coloring procedures, and a kit for use in coloring the hair and touching up the hair color between oxidative coloring procedures.

50 Claims, 5 Drawing Sheets

U.S. PATENT DOCUMENTS

| | | | | | |
|---|---|---|---|---|---|
| 5,018,894 | A | | 5/1991 | Goncalves | 401/202 |
| 5,051,016 | A | | 9/1991 | Bengston | 401/213 |
| 5,230,579 | A | | 7/1993 | Klawson | 401/205 |
| D342,021 | S | | 12/1993 | Porta | D9/338 |
| D351,338 | S | | 10/1994 | Koptis | D9/309 |
| 5,577,851 | A | | 11/1996 | Koptis | 401/202 |
| 5,702,712 | A | * | 12/1997 | Wenke et al. | 424/401 |
| 5,871,020 | A | | 2/1999 | DeVone | 132/317 |
| 5,908,256 | A | | 6/1999 | Bernstein | 401/205 |
| 5,931,973 | A | * | 8/1999 | Malle et al. | 8/431 |
| 5,961,664 | A | * | 10/1999 | Anderson | 8/405 |
| 5,961,665 | A | | 10/1999 | Fishman | 8/406 |
| 5,972,322 | A | * | 10/1999 | Rath et al. | 424/70.11 |
| 6,030,138 | A | | 2/2000 | Losier | 401/266 |
| 6,106,578 | A | * | 8/2000 | Jones | 8/406 |
| 6,231,259 | B1 | | 5/2001 | Murgida | 401/175 |
| 6,234,698 | B1 | | 5/2001 | DeLaforcade | 401/175 |
| 6,238,653 | B1 | | 5/2001 | Narasimhan | 424/62 |
| 6,334,727 | B1 | * | 1/2002 | Gueret | 401/47 |
| 6,547,471 | B1 | | 4/2003 | Tucker et al. | 401/206 |
| 6,635,262 | B2 | | 10/2003 | Jourdan | 424/400 |
| 2003/0074746 | A1 | | 4/2003 | Fischer | 8/405 |

* cited by examiner

PACKAGED HAIR COLOR COMPOSITION AND METHOD FOR COLORING HAIR

TECHNICAL FIELD

The invention is in the field of hair color compositions contained in dispensing containers. More particularly, the invention is in the field of semi-permanent or temporary hair color compositions contained in dispensing containers that are used to "touch up" hair color between oxidative dying procedures.

BACKGROUND OF THE INVENTION

It is estimated that about fifty percent of the female population colors their hair. In most cases the hair is colored to cover gray. In a smaller percentage of cases, the user simply desires to change the color of her hair.

Oxidative, or "permanent" hair color, which permanently changes the color of the hair, is most often used by consumers. This type of hair color permanently changes the color of the hair. However, because hair grows about ¼ to ½ inch per month, new hair growth becomes evident at the hair roots in a month's time. Further, it is sometimes seen that oxidatively colored hair around the temples may fade first revealing visible gray or originally colored strands.

Accordingly, consumers who color their hair with permanent color generally repeat the procedure every four to six weeks so that new hair growth can be colored and any faded strands can be re-colored. Even with repeat procedures every four to six weeks, fading and new hair growth at the roots are still evident on certain users. Hair color users find it enough of a burden to recolor their hair every four to six weeks, much less having to worry about coloring more often then that to touch up new hair growth or faded strands.

Accordingly, there is a need for a simple, inexpensive method, device, and kit to enable those who oxidatively color their hair to touch up the color in between oxidative coloring procedures. The method and component should be inexpensive to manufacture, the touch up hair color should act on the select hair strands to touch up color in a short period of time, and the product should be storage stable. Ideally, the touch up color should be contained in a small single use container or a multiple use container that can be stored in between usages.

It is an object of the invention to provide a method for touching up oxidatively colored hair between oxidative dyeing procedures—specifically to touch up new growth or faded areas—so that the consumer does not have to oxidatively color the hair as often.

It is a further object of the invention to provide a packaged hair color composition that can be used by a consumer to touch up the new hair growth or faded hair strands.

It is a further object of the invention to provide a packaged semi-permanent hair color composition dispensed from a single or multiple use container, for use in touching up faded hair or new hair growth between oxidative coloring procedures.

Because semi-permanent color does not require mixing prior to use, but rather can be stored and dispensed from a single container, it is preferred for use in the packaged hair color product of the invention.

SUMMARY OF THE INVENTION

The invention is directed to a packaged hair color composition comprising a flowable aqueous semi-permanent hair dye composition contained in a container having a porous dispensing outlet operable to express the aqueous hair dye composition onto the hair to be colored upon contact of the porous dispensing outlet therewith.

The invention is further directed to a method for coloring hair with a packaged hair color composition comprising an aqueous semi-permanent hair dye composition contained in a container having a porous dispensing outlet operable to express the aqueous hair dye composition onto the hair to be colored upon contact of the porous dispensing outlet therewith, comprising the steps of: (a) contacting the porous dispensing outlet with the hair to be colored; and (b) expressing the hair dye through the porous dispensing outlet onto the hair to be colored.

The invention is further directed to a method for restoring color to faded or discolored strands of hair, or applying color to new hair growth, between oxidative hair color procedures, comprising contacting the faded or discolored strands of hair or new hair growth with an aqueous semi-permanent hair dye composition contained in a container having a porous dispensing outlet operable to express the aqueous hair dye composition onto the faded or discolored strands or new hair growth upon contact of the porous dispensing outlet therewith, comprising contacting the faded or discolored strands of hair or new hair growth with the porous dispensing outlet, and expressing the hair dye thereon.

The invention is further directed to a kit for coloring hair comprising, (a) a first receptacle for containing an aqueous oxidizing agent composition, (b) a second receptacle containing an oxidative hair color composition having a certain color, and (c) a third receptacle containing semi-permanent hair color composition having the same or similar color as the oxidative hair color composition in the second receptacle, wherein the mixture of compositions of (a) and (b) is used to oxidatively color the hair and the composition of (c) is used to touch up faded hair strands or new hair growth in the hair that has been treated with the mixture of compositions (a) and (b).

BRIEF DESCRIPTION OF THE DRAWINGS

FIG. 2 further illustrates the operation of the closure that opens and closes the container. This container does not have an integral closure.

FIG. 6: illustrates one preferred embodiment of the invention containing a kit for oxidative coloring of hair and touching up the hair between oxidative coloring procedures.

DETAILED DESCRIPTION

The Container

FIGS. 1–5 illustrate various types of containers that can be used in the packaged hair color composition of the invention.

Figure 1:
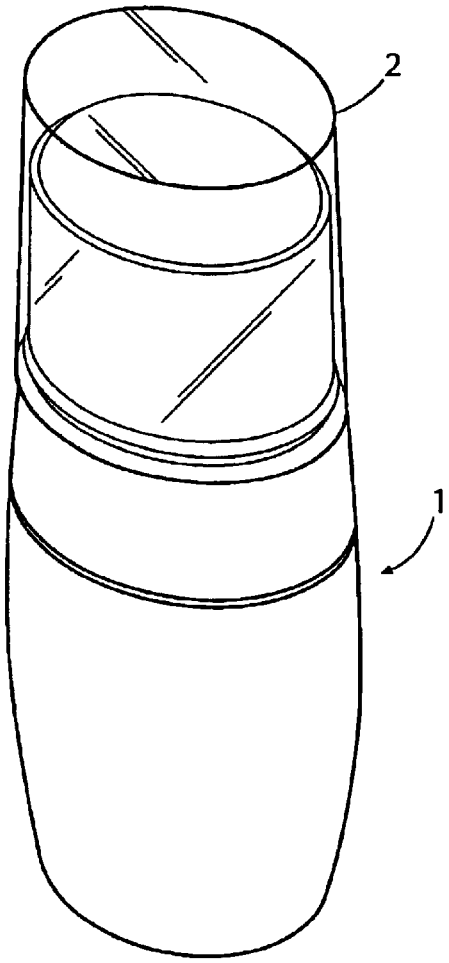
FIG. 1: is an illustration of the preferred embodiment of the packaged hair color composition of the invention in the fully closed form.

FIG. 1 illustrates one embodiment of a container 1 suitable for use with the hair color composition in the fully closed position. The container 1 may be made of any material suitable for use with hair color including glass or plastic, but preferably the container is made from thermoplastic polymeric materials such as ABS, polyethylene, polypropylene, styrene, etc. Such thermoplastic materials have good compatibility with hair color compositions and are sturdy enough to withstand the stresses found in manufacturing, filling, and shipping of product.

Figure 2:
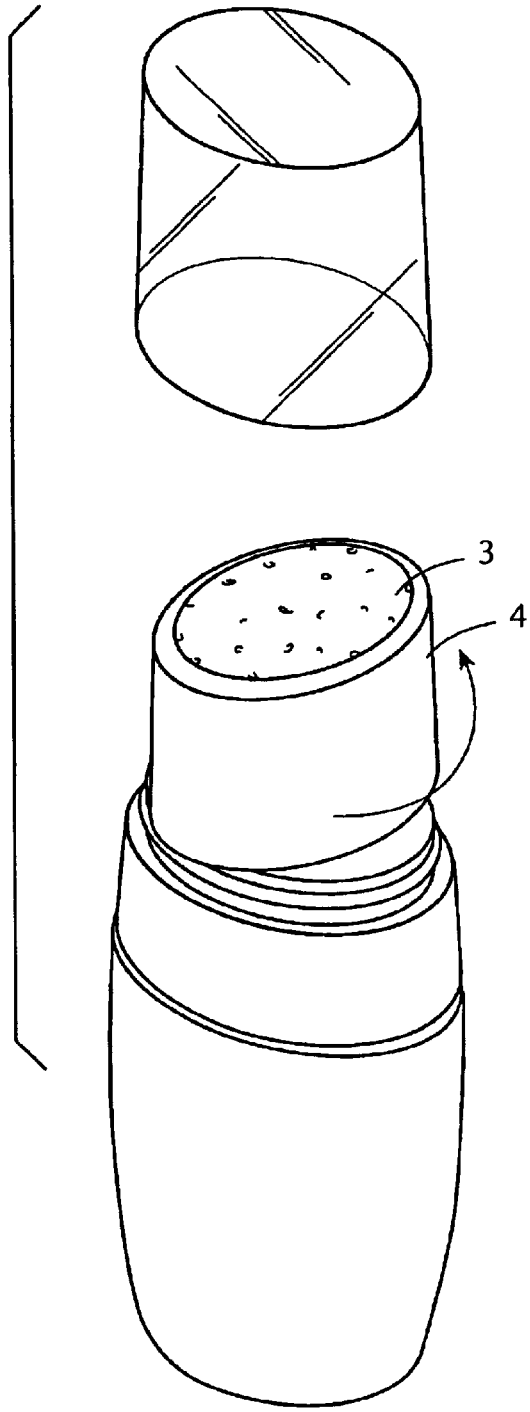
FIG. 2: is an illustration of the preferred embodiment of the packaged hair color composition showing the cap removed from the container and the porous dispensing outlet.

The container 1 preferably contains a cap 2 and an applicator 3 in the form of a porous dispensing outlet which is part of a closure 4 that is integral with the container. As is seen in FIG. 2, the closure 4 is rotated to open the container. When it is desired to close the container 1 the closure 4 is rotated in the opposite direction. It is noted that while the closure is rotated to open and close the container the movement could be other than rotation, for example, the closure can be moved up or down to open and close the container. When the closure 4 is in the open position it permits the hair color composition within the container 3 to flow from the container 3 onto the applicator 3 in the form of a porous dispensing outlet.

The term "porous dispensing outlet" means that the applicator which is placed in contact with the hair has pores or holes which permit the composition to flow through the pores onto the hair when the semi-permanent hair dye composition is expressed from the container and the porous dispensing outlet is placed into contact with the hair to be colored.

The container of FIG. 1 is more completely described in copending patent application Docket No. Rev 01-20-III, entitled Container For Storing and Dispensing Flowable Products, naming inventors Glenn Robert Geardino, Manharbhai Kantibhai Patel, Barry Hutton, Michael Corcoran, William Heron, Lou Ann Christine Vena, Melissa Kellett-Miczewski, and Maxine Gayle Moore, filed on even date herewith and which is hereby incorporated by reference in its entirety, including the drawings.

Figure 3:
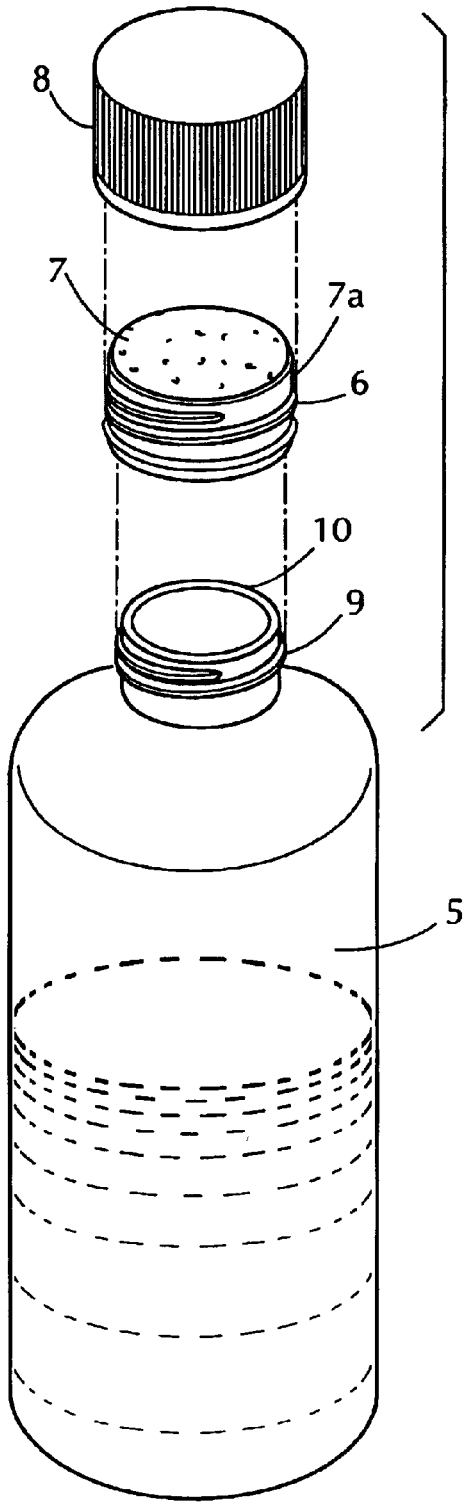
FIG. 3: illustrates another type of packaged hair color composition of the invention wherein the package does not contain an integral closure.

Also suitable for use in storing and dispensing the semi-permanent hair color composition in the packaged hair color composition of the invention is a container as depicted in FIG. 3. This container has a receptacle 5 for storing the semi-permanent hair color, a cap 6 having a porous dispensing outlet 7 in the form of a flat planar surface of foam or similar porous material affixed to a circular closure 7A with engaging threads 7B (not shown) that facilitate attachment of the circular closure 7A to the threads 9 on the outer surface of receptacle neck 10. A secondary lid 8 may be affixed to the receptacle to close it during storage.

Figure 4:
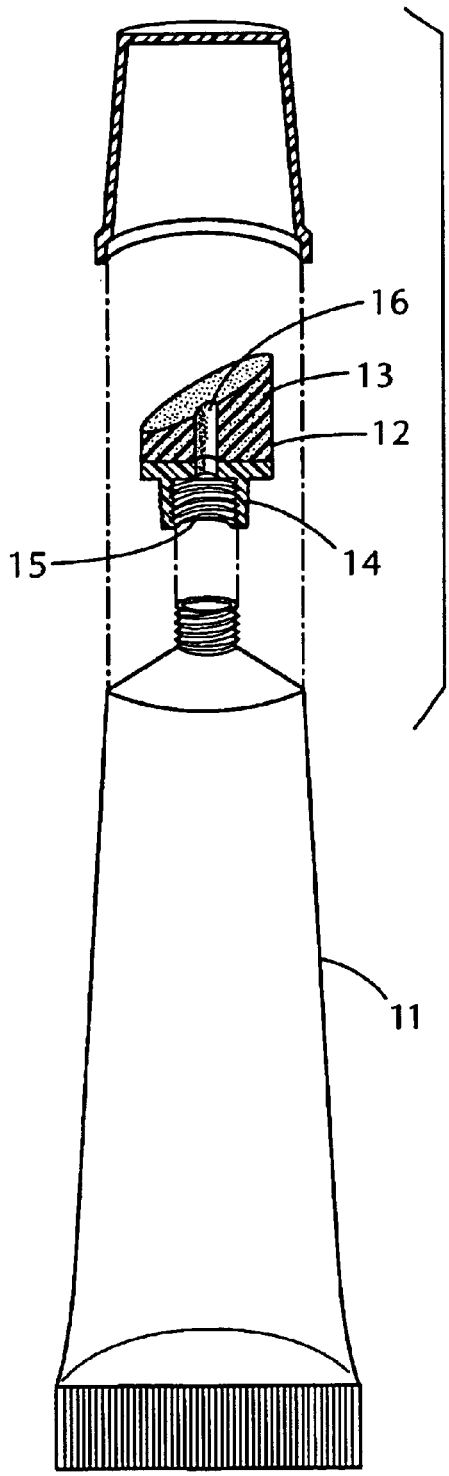
FIG. 4: ilustrates another type of packaged hair color composition of the invention where the container is a tube.

Another type of container that may be used in the packaged hair color composition of the invention is set forth in FIG. 4. The FIG. 4 container comprises a tube 11 for holding the hair color composition, and a porous dispensing outlet 12 in the form of a sponge applicator 13. The sponge applicator 13 is affixed to the lid 14 of the tube 11. While the hair color can simply be expressed from the tube through channel 15 onto sponge applicator 13, FIG. 4 illustrates that the sponge applicator 13 may also contain a channel 16 that will permit flow of the hair color composition from the tube 11 onto the sponge applicator 13 so that it can be applied to the hair.

Figure 5:
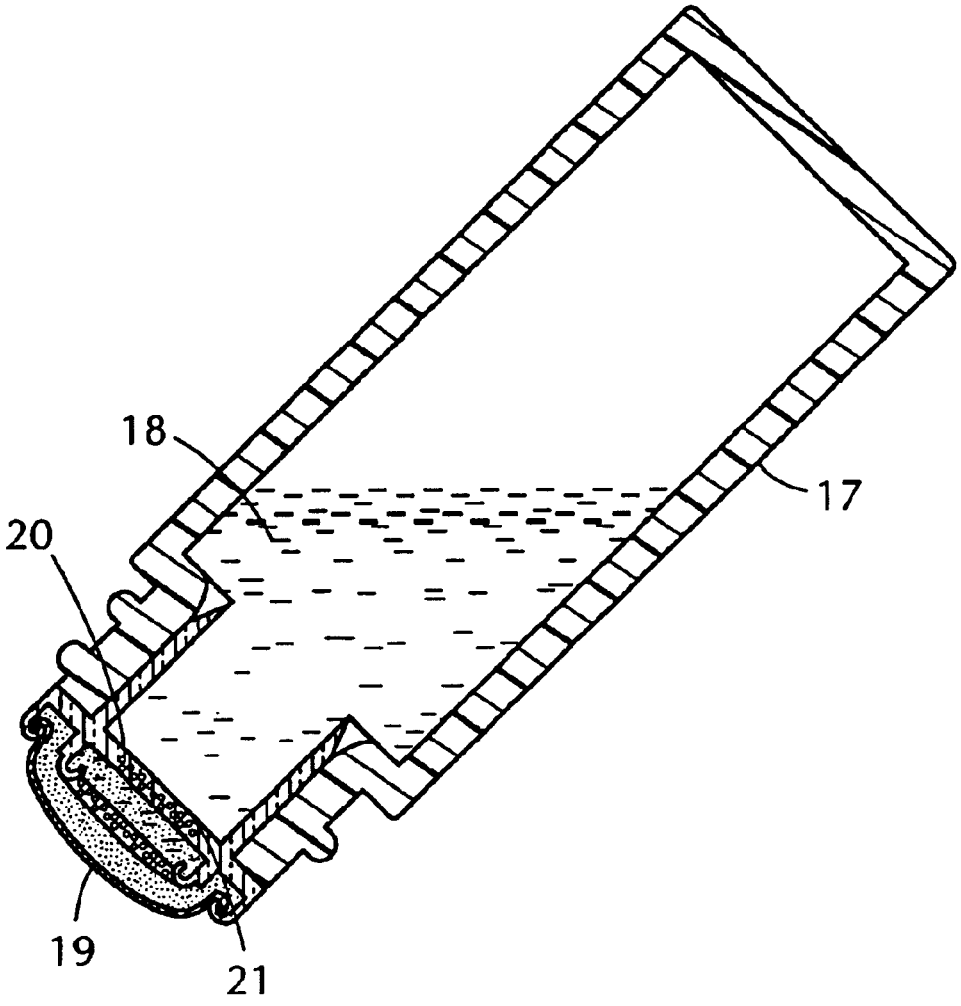
FIG. 5: is cut away view of another type of packaged hair color composition according to the invention which shows how the container may be inverted to express the hair color composition onto the hair (hair not shown).

FIG. 5 is a cut away view of a another type of container for the packaged hair color composition of the invention. In FIG. 5 the container 17 is shown in the inverted position so that the hair color composition 18 of the invention can be expressed from the container 17 through the porous dispensing outlet 19 and onto the hair. In this case the porous dispensing outlet 19, preferably a sponge or similar porous open celled thermoplastic material is affixed to a cap 20 which contains pores 21 through which the hair color composition 18 can flow when the container is squeezed with the fingers to express the hair color composition 18. The hair color composition 18 will flow through pores 21 into porous dispensing outlet 19. When porous dispensing outlet 19 is placed into contact with the hair to be colored, the hair color composition 18 will be applied thereto.

The Composition

The containers are used to store and dispense an aqueous based semi-permanent hair color. The term "semi-permanent" means that the hair color contains at least one semi-permanent hair dye, or in other words, a dye operable to color hair by itself, without being combined with any oxidizing agents or other activators. The hair color is aqueous based and should be flowable, meaning that it while it may be a solid or semi-solid in addition to a liquid, it should flow upon application of shear stress Preferably the aqueous semi-permanent hair dye composition is in the liquid form. The semi-permanent dye is a water soluble or water dispersible dye, as is further described herein.

A. The Water Soluble or Dispersible Dye

The water soluble or water dispersible dye is operable to color the hair when contacted therewith. The phrase "operable to color hair when contacted therewith" means that the dye alone, without combining with any additional activators or accelerators, will color the hair (as opposed to certain types of oxidative dyes that must be combined with an activator in order to impart color to the hair fiber).

A variety of dyes are suitable including direct dyes, disperse dyes, acid dyes, basic, dyes, direct, dyes, and so on. Suitable amounts of dye preferably range from about 0.001–20%, preferably about 0.005–15%, more preferably about 0.010–10% by weight of the total composition. Preferred are the compounds that fall into the general category of semi-permanent dyes. Examples of such dyes are set forth below:

1. Basic Dyes

Suitable basic dyes include blues, browns, greens, oranges, reds, and yellows. Suitable blues include Basic Blue 3, 6, 7, 9, 26, 41, 47, and 99. Suitable browns include Basic Browns 4, 16, and 17. Suitable greens include Basic Green 1 and 4. Suitable oranges include Basic Orange 1 and 2. Suitable Reds include Basic Red 1, 2, 22, 46, 76, and 118. Suitable violets include Basic Violet 1, 3, 4, 10, 11:1, 14, and 16. Suitable yellows include Basic Yellow 11, 28, and 57.

Suitable basic dyes for use in the claimed compositions are set forth in the CTFA Cosmetic Ingredient Handbook, Eighth Edition, pages 117–124, which are hereby incorporated by reference in their entirety.

2. HC Dyes

Also suitable for use in the compositions are various HC dyes such as blue, brown, green, orange, red, violet, and yellow. Suitable blues include HC Blue 2, 4, 5, 6, 7, 8, 9, 10, 11, 12, 13, and 14. Suitable browns include HC Brown 1 and 2. Suitable greens include HC Green 1. Suitable oranges include HC Orange 1, 2, 3, and 5. Suitable reds include HC Red 1, 3, 7, 8, 9, 10, 11, 13, and 14. Suitable violets include HC Violet 1 and 2. Suitable yellows include HC Yellow 2, 4, 5, 6, 7, 8, 9, 10, 11, 13, 14, and 15. Such HC dyes are set forth on pages 615–623 of the CTFA Cosmetic Ingredient Handbook, Eighth Edition, 2000, which is hereby incorporated by reference in its entirety.

3. Acid Dyes

Also suitable for use in the compositions are various acid dyes such as black, blue, brown, green, orange, red, violet, and yellow. Examples of Acid Black are numbers 1 and 52. Suitable blues include Acid Blue 1, 3, 9, 62, and 74, including Lakes thereof Examples of browns and greens include Acid Brown 13 and Acid Green 1, 25, and 50, respectively. Suitable oranges include Acid Orange 3, 6, 7, and 24. Suitable reds include Acid Red 14, 18, 27, 33, 35, 51, 52, 73, 87, 92, 95, 184, and 195. Suitable violets include Acid Violet 9 and 43. Suitable yellows include Acid Yellow 1, 3, 23, and 73. In each case the dyes may be Lakes thereof. Such Acid dyes are set forth on pages 13–23 of the CTFA Cosmetic Ingredient Handbook, Eighth Edition, 2000, which is hereby incorporated by reference in its entirety.

4. Direct and Disperse Dyes

Also suitable are various types of dyes referred to as direct dyes or disperse dyes. Suitable direct dyes include Direct Black 51, Direct Blue 86, Direct Red 23, 80, and 81; Direct Violet 48, and Direct Yellow 12. Such direct dyes are set forth on pages 469–471 of the CTFA Cosmetic Ingredient Handbook, Eighth Edition, 2000, which is incorporated by reference in its entirety.

Suitable disperse dyes include Disperse Black 9, Disperse Blue 1, 3, and 7; Disperse Brown 1, Disperse Orange 3, Disperse Red 11, 15, and 17; and Disperse Violet 1, 4, and 15. Such disperse dyes are as set forth on 491–493 of the CTFA Cosmetic Ingredient Handbook, Eighth Edition, 2000, which is hereby incorporated by reference in its entirety In the preferred packaged hair color composition of the invention, HC dyes and the Disperse dyes are used as the semi-permanent dyes.

B. Other Ingredients

1. Surfactants

A variety of suitable surfactants may be used in the hair color composition, including anionic, cationic, nonionic, amphoteric, or zwitterionic. Generally the amount of the surfactant required will depend on the other ingredients present in the composition, but may preferably range from about 0.001–50%, preferably about 0.005–45%, more preferably about 0.01–40% by weight of the total composition. The surfactants selected may form association structures, and will facilitate flow of the hair color composition from the container, through the porous dispensing outlet, onto the hair. Such surfactants are organic, amphiphilic, surface active ingredients that will form a certain molecular order in a polar solvent, or aqueous phase having the hair color ingredients contained therein. The term "amphiphilic" means that the surface active material contains both lipophilic and hydrophilic portions such that the hydrophilic portion of the molecule is attracted to, and orients with, the polar, aqueous phase ingredients in the composition, and the lipophilic portion of the molecule is attracted to, and orients with the nonpolar phase of the composition. Examples of radicals that will confer hydrophilicity include hydroxypolyethyleneoxy, hydroxyl, carboxylates, sulfonates, sulfates, phosphates, or amines. Examples of radicals that will confer lipophilicity are $C_{1-40}$ straight or branched chain alkyl, fluoro, aryl, aryloxy, $C_{1-40}$ hydrocarbyl acyl, hydroxypolypropyleneoxy, or mixtures thereof. The $C_{1-40}$ alkyl may be non-interrupted, or interruped by one or more oxygen atoms, a benzene ring, amides, esters, or other functional groups. Examples of suitable organic, amphiphilic, surface active agents include nonionic, amphoteric, cationic, and anionic surface active agents. The organic, amphiphilic, surface active agent may be a liquid, semi-solid, or solid at room temperature.

(i) Nonionic Surfactants

A variety of nonionic surface active agents may be used in the claimed compositions. Preferably, such surface active agents HLB (hydrophile/lipophile balance) of about 12–20, more preferably about 13–16. Nonlimiting examples of nonionic surfactants include.

Alkoxylated Alcohols

Suitable alkoxylated alcohols include ethers formed from the reaction of an aliphatic, aromatic, or heterocyclic alcohol with an alkylene oxide, generally ethylene or propylene oxide. Preferably, the alcohol is an aliphatic alcohol, more preferably a fatty alcohol having 10–22 carbon atoms; and the alkylene oxide is ethylene oxide. Examples of preferred alkoxylated alcohols include steareth, ceteth, ceteareth, beheneth, and the like, having from 1 to 200 repeating ethylene oxide units, as well as PEG derivatives of fatty acids such as PEG dioleate, PEG distearate, PEG isostearate, and so on.

Sorbitan Derivatives

Suitable sorbitan derivatives are esters or ethers or sorbitan, which is a heterocyclic ether formed by the dehydration of sorbitol. Sorbitan may be derivatized by ethoxylation and/or esterification of the hydroxyl groups. Suitable acids used for esterification include C1–30 acids, more preferably, fatty acids having 6–22 carbon atoms. Examples of suitable sorbitan derivatives include PEG derivatives of sorbitan wherein the number of repeating ethylene oxide units ranges from 2 to 200, such as PEG sorbitan beeswax, glyceryl/sorbitol/oleate/hydroxystearate, PEG sorbitan cocoate, PEG sorbitan diisostearate, PEG sorbitan isostearate, PEG sorbitan lanolate, PEG sorbitan laurate, PEG sorbitan oleate, PEG sorbitan palmitate, PEG sorbitan perisostearate, PEG sorbitan peroleate, PEG sorbitan stearate, PEG sorbitan tetraoleate, PEG sorbitan tetrastearate, PEg sorbitan triisostearate; Polysorbates such as Polysorbate 20–85, Polysorbate 80 acetate; and sorbitan esters such as sorbitan caprylate, cocoate, diisostearate, dioleate, distearate, isostearate, laurate, oleate, olivate, palmitate, sesquiisostearate, sesquioleate, sesquistearate, stearate, triisostearate, trioleate and the like.

Glyceryl Ethers

Also suitable are linear or branched ethers of polyglycerol having the general formula:

$$R\text{-}(Gly)_n\text{-}OH$$

wherein n is 1–10 and R is a straight or branched, saturated or unsaturated alkyl having 6 to 30 carbon atoms, and Gly is the glycerol residue. Examples of suitable polyglyceryl derivatives include polyglyceryl decaoleates, polyglyceryl caprates, polyglyceryl diisostearates, polyglyceryl distearates, polyglyceryl isopalmitates, polyglyceryl laurates, and the like.

Glyceryl Esters

Suitable glyceryl esters include alkoxylated glyceryl esters include synthetic or semi-synthetic glyceryl esters, e.g. fatty acid mono-, di-, and triglycerides which are natural fats or oils that have been modified, for example, by reaction with alkylene oxide units, preferably ethylene oxide units. Examples of such glyceryl esters include PEG glyceryl oleates, PEG glyceryl stearates and isostearates, PEG glyceryl laurates, PEG glyceryl tallowates, and so on. Preferred PEG glyceryl esters include those of the formula:

$$RC(O)OCH_2CH(OH)CH_2(OCH_2CH_2)_nOH$$

wherein n is 5–200 and RC(O)— is a hydrocarbylcarbonyl group wherein R is preferably an aliphatic radical having 7 to 19 carbon atoms.

Also suitable are glyceryl esters formed by the reaction of glycerol with one or more fatty acids. Examples of these glyceryl esters include glyceryl adipate, caprylate, cocoate, stearate, diisostearate, laurate, linoleate, and so on.

Dialkyl Sulfoxides

Also suitable are long chain dialkyl sulfoxides containing one short chain alkyl or hydroxy alkyl radical of from about 1 to 3 carbon atoms and one long hydrophobic chain which may be an alkyl, alkenyl, hydroxyalkyl, or ketoalkyl radical containing from about 8 to 20 carbon atoms, from 0 to 10 ethylene oxide moieties, and 0 or 1 glyceryl moiety.

Polyethylene Oxide Condensates of Alkyl Phenols

Suitable condensates include the condensation products of alkyl phenols having an alkyl group of 6 to 20 carbon atoms with ethylene oxide being present in amounts of about 10 to 60 moles of ethylene oxide per mole of alkyl phenol.

Condensation Products of Ethylene Diamine

Examples of suitable condensation products of ethylene diamine include products of ethylene oxide with the reaction product of propylene oxide and ethylene diamine.

Long Chain Tertiary Amine Oxides

Preferred long chain tertiary amine oxides include those corresponding to the general formula:

$$R_1R_2R_3NO$$

wherein $R_1$ contains an alkyl, alkenyl or monohydroxyalkyl radical ranging from about 8 to 18 carbon atoms in length, from 0 to about 10 ethylene oxide moieties, and from 0 to about 1 glyceryl moiety and $R_2$ and $R_3$ are each alkyl or monohydroxyalkyl groups containing from about 1 to about 3 carbon atoms.

Long Chain Tertiary Phosphine Oxides

Suitable long chain tertiary phosphine oxides include those corresponding to the general formula:

$$RR_1R_2PO$$

wherein R contains an alkyl, alkenyl, or monohydroxyalkyl radical having 8 to 18 carbon atoms, from 0–10 ethylene oxide moieties and 0 or 1 glyceryl moiety, and $R_2$ and $R_3$ are each alkyl or monohydroxyalkyl group containing from about 1 to 3 carbon atoms.

Polyhydroxyl Fatty Acid Amides

Examples of $C_{10-18}$ alkyl($C_{1-6}$)polyhydroxy fatty acid amides such as $C_{12-18}$ methylglucamides, N-alkoxy polyhydroxy fatty acid amides, N-propyl through N-hexyl $C_{12-18}$ glucamides and so on.

Alkyl Polysaccharides

Suitable nonionic surfactants are alkyl polysaccharides, or alkyl glycosides, disclosed in U.S. Pat. Nos. 5,716,418 and 5,756,079, both of which are hereby incorporated by reference. These alkylglycosides have the general formula:

$$R_1—O—(R_2O)_t\text{-}(G)_n\text{-}H$$

wherein $R_1$ is a linear or branched alkyl or alkenyl radical having 12 to 30 carbon atoms, $R_2$ is a $C_{2-4}$ alkylene, (G) is an anhydroglucose unit, t is a number between 0 and 10, preferably 0 to 4, and n is a number from about 1 to 15. Examples of such alkyl polysaccharides are octyl, nonydecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses, and so on. Certain polyglycosides having the above formula are sold by Henkel Corporation under the tradenamnes APG 300, APG 350, APG 500, APG 550, APG 625, or the tradename Planteren, e.g. Planteren 300, 600, 1200, 2000, and so on.

Particularly preferred nonionic surfactants for use in the claimed compositions are alkoxylated alcohols, glyceryl esters, and polyethylene glycol derivatives of fatty acids.

(ii) Anionic Surfactants

Also suitable for use as the amphiphilic surface active material are one or more anionic surfactants.

Alkyl Sulfates

Anionic surfactants include alkyl and alkyl ether sulfates generally having the formula $ROSO_3M$ and $RO(C_2H_4O)_xSO_3M$ wherein R is alkyl or alkenyl of from about 10 to 20 carbon atoms, x is 1 to about 10 and M is a water soluble cation such as ammonium, sodium, potassium, or triethanolamine cation.

Another type of anionic surfactant which may be used in the compositions of the invention are water soluble salts of organic, sulfuric acid reaction products of the general formula:

$$R_1—SO_3\text{-}M$$

wherein $R_1$ is chosen from the group consisting of a straight or branched chain, saturated aliphatic hydrocarbon radical having from about 8 to about 24 carbon atoms, preferably 12 to about 18 carbon atoms; and M is a cation. Examples of such anionic surfactants are salts of organic sulfuric acid reaction products of hydrocarbons such as n-paraffins having 8 to 24 carbon atoms, and a sulfonating agent, such as sulfur trioxide.

Fatty Acids Esterified with Isethionic Acid

Also suitable as anionic surfactants are reaction products of fatty acids esterified with isethionic acid and neutralized with sodium hydroxide. The fatty acids may be derived from coconut oil or other similar vegetable or animal derived oils that contain fatty acids.

Succinates or Succinimates

In addition, succinates and succinimates are suitable anionic surfactants. This class includes compounds such as disodium N-octadecylsulfosuccinate; tetrasodium N-(1,2-dicarboxyethyl)-N-octadecylsulfosuccinate; and esters of sodium sulfosuccinic acid e.g. the dihexyl ester of sodium sulfosuccinic acid, the dioctyl ester of sodium sulfosuccinic acid, and the like.

Olefin Sulfonates

Other suitable anionic surfactants include olefin sulfonates having about 12 to 24 carbon atoms. The term "olefin sulfonate" means a compound that can be produced by sulfonation of an alpha olefin by means of uncomplexed sulfur trioxide, followed by neutralization of the acid reaction mixture in conditions such that any sultones which have been formed in the reaction are hydrolyzed to give the corresponding hydroxy-alkanesulfonates. The alpha-olefin from which the olefin sulfonate is derived is a mono-olefin having about 12 to 24 carbon atoms, preferably about 14 to 16 carbon atoms.

Other classes of suitable anionic organic surfactants are the beta-alkoxy alkane sulfonates or water soluble soaps thereof such as the salts of $C_{10-20}$ fatty acids, for example coconut and tallow based soaps. Preferred salts are ammonium, potassium, and sodium salts.

N-Acyl Amino Acids

Still another class of anionic surfactants include N-acyl amino acid surfactants and salts thereof (alkali, alkaline earth, and ammonium salts) having the formula:

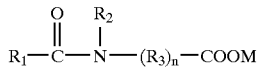

wherein $R_1$ is a $C_{8-24}$ alkyl or alkenyl radical, preferably $C_{10-18}$; $R_2$ is H, $C_{1-4}$ alkyl, phenyl, or —$CH_2COOM$; $R_3$ is $CX_2$— or $C_{1-2}$ alkoxy, wherein each X independently is H or a $C_{1-6}$ alkyl or alkylester, n is from 1 to 4, and M is H or a salt forming cation as described above. Examples of such surfactants are the N-acyl sarcosinates, including lauroyl sarcosinate, myristoyl sarcosinate, cocoyl sarcosinate, and oleoyl sarcosinate, preferably in sodium or potassium forms.

(iii) Cationic, Amphoteric, or Zwitterionic Surfactants

Certain types of amphoteric, zwitterionic, or cationic surfactants may also be used as the amphiphilic surface active material. Descriptions of such surfactants are set forth in U.S. Pat. No. 5,843,193, which is hereby incorporated by reference in its entirety.

(b) Polar Solvents

A variety of polar solvents may be suitable including water, mono-, di-, or polyhydric alcohols, and similar water soluble ingredients. Typically the hair color composition comprises from about 0.1–99.9%, preferably about 5–95%, more preferably about 10–90% by weight of the total composition of polar solvent which includes water. Other suitable non-aqueous Suitable monohydric alcohols include ethanol, isopropanol, benzyl alcohol, butanol, pentanol, ethoxyethanol, and the like. Examples of dihydric, or polyhydric alcohols, as well as sugars and other types of humectants that may be used include glucose, fructose, mannose, mannitol, malitol, lactitol, inositol, and the like. Suitable glycols include propylene glycol, butylene glycol, ethylene glycol, polyethylene glycols having from 4 to 250 repeating ethylene glycol units, ethoxydiglycol, and the like. Many of these types of alcohols serve also serve as penetration enhancers, meaning that they enhance penetration of the dyes into the hair shaft by virtue of their tendency to act as humectants and swell the hair shaft. Ethoxydiglycol is a particularly good penetration enhancer.

In the preferred embodiment of the invention the hair color composition comprises water in addition to one or more polar solvents which are dihydric alcohols. In the preferred compositions, about 0.001–20%, preferably about 0.005–10%, more preferably about 0.001–8% by weight of the total composition is a non-aqueous polar solvent.

(c) Lipophilic Materials

Preferably, certain lipophilic materials are used in addition to the surfactants and polar solvents to form the association structures. Preferred lipophilic materials include:

(i). Fatty Acids

The semi-permanent hair color composition may contain one or more fatty acids. Suitable fatty acids are carboxylic acids having the general formula R—COOH wherein R is a straight or branched chain, saturated or unsaturated alkyl having about 7 to 30 carbon atoms. Suggested ranges of fatty acid, if present, are about 0.01–25%, preferably about 0.05–20%, preferably about 0.1–15% by weight of the total composition. Suitable fatty acids include oleic, palmitic, arachidic, arachidonic, behenic, capric, caproic, capryllic, coconut, tallow, lauric, linoleic, linolenic, myristic, pelargonic, ricinoleic, stearic, undecylenic, and so on. Particularly preferred is oleic acid, an unsaturated fatty carboxylic acid. The fatty acids aid in the formation of liquid crystals.

(ii). Fatty Alcohols

One or more fatty alcohols may be included in the composition. Fatty alcohols exhibit the general formula R—$CH_2OH$ where R is a straight or branched chain, saturated or unsaturated alkyl having about 7 to 30 carbon atoms. Suggested ranges of fatty alcohols, if present, are about 0.001–15%, preferably about 0.005–10%, preferably about 0.01–8% by weight of the total composition. Examples of suitable fatty alcohols include arachidyl alcohol, C9–11 alcohols, C12–13 alcohols, C12–15 alcohols, C12–16 alcohols, C14–15 alcohols, caprylic alcohol, cetearyl alcohol, cetyl alcohol, coconut alcohol, decyl alcohol, palm alcohol, lauryl alcohol, myristyl alcohol, oleyl alcohol, tallow alcohol, tridecyl alcohol, and mixtures thereof. Particuarly preferred is oleyl alcohol, cetearyl alcohol, and mixtures thereof.

In the most preferred embodiment of the packaged hair color composition and methods of the invention, the hair color composition is as set forth in copending patent application case docket no. Rev 01-20-I, entitled "Hair Color Compositions and Methods for Coloring Hair", naming inventors Melissa Kellett-Miczewski, Lou Ann Christine Vena, and Saroja Narasimhan filed on even date herewith, and hereby incorporated by reference in its entirety.

The Method

The invention further comprises a method for coloring hair using the packaged hair color composition of the invention, including a method for touching up the color of the hair between oxidative dyeing procedures.

When a consumer who colors their hair with oxidative color first notices root growth, or a few strands of hair that have faded or become discolored, the consumer can use the packaged hair color composition of the invention to apply color to the new root growth or faded strands. This is done by contacting the porous dispensing outlet with the hair to be colored. In the preferred embodiment of the invention, the hair color composition in the container is expressed from the container onto the desired hairs by application of shear stress, e.g. pressing the container with the fingers to express the composition from the container onto the hair. Alternatively, gravity or capillary action will also work but it will take a longer time for the hair color composition to flow from the container. In other words the container is held in a slightly inverted position while the porous dispensing outlet is contacted with the desired strands of hair and the hair color in the container is expressed, or flows, onto the hair strands. The container can be stroked across the hairs to be colored in the manner of a paint brush or applicator. This type of container is easy for the consumer to handle and enables targeting of the hair color composition to the desired areas. The hair color can also be used by consumers who do not color their hair by oxidative procedures on a regular basis, but rather have virgin hair that is beginning to gray. Rather than color the whole head of hair, these types of consumers may simply want to touch up these gray hairs. The hair color may also be used by men who desire to touch up the color of hair, beards, or mustaches.

The hair color is applied to the target areas using the packaged hair color composition. The hair color can be applied to dry hair. The hair color is left on the hair for a time sufficient to cause color to develop, which is generally from about 3 to 45 minutes, but more preferably from about 5–15 minutes, most preferably less than about 10 minutes. After the appropriate period of time has elapsed, the user simply rinses the color out of the hair using water and washes or dries the hair as desired. It may be desirable for the consumer to apply the composition to the hair, wait the appropriate period of time, then wash the hair dye out of the hair while showering or bathing.

The method of the invention using the packaged hair color composition provides a quick, inexpensive, and consumer friendly way to touch up hair color between intermittent oxidative dye procedures.

The Kit

The invention further comprises a kit for oxidatively coloring hair and touching up the new hair growth or faded or discolored strands after the oxidative dye procedure or between oxidative dyeing procedures. The kit is depicted in FIG. 6.

The kit preferably contains some type of storage container 22 that may be a cardboard or plastic box. Inside the container 22 are the components necessary to oxidatively or permanently color hair.

Figure 6A:
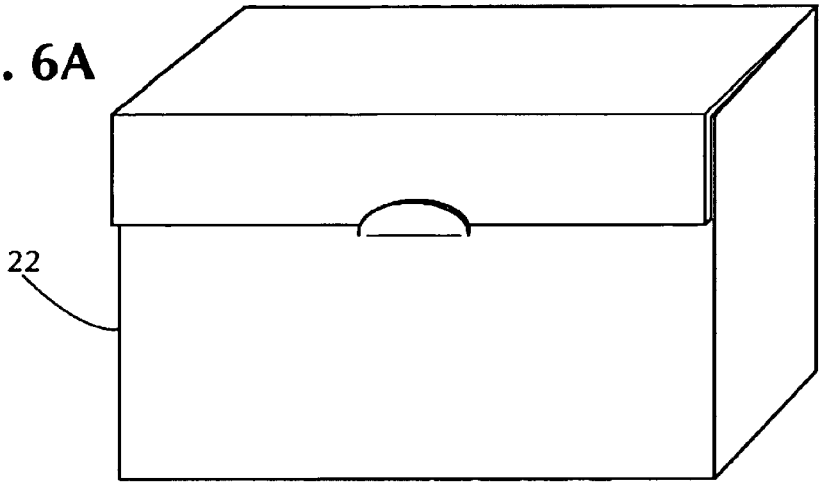
FIG. 6A illustrates a box or similar storage receptacle for holding the various components of the kit.
Figure 6B:
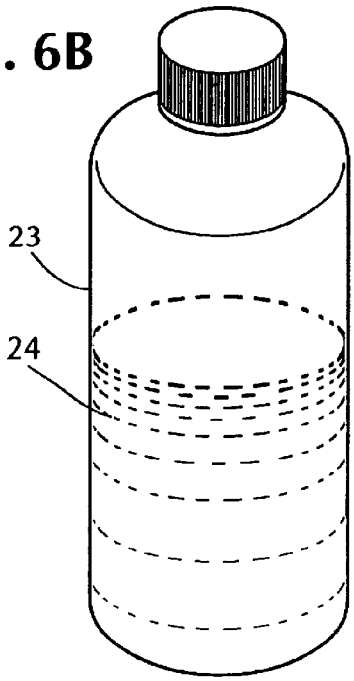
FIG. 6B illustrates the aqueous peroxide composition.
Figure 6C:
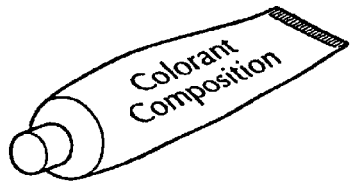
FIG. 6C shows the oxidative colorant composition.

In particular, in FIG. 6B is a container 23 used to contain an aqueous peroxide composition 24 which is a necessary activator for the oxidative, or permanent, dyes used in oxidative hair color. FIG. 6C illustrates the oxidative hair colorant composition.

When the consumer desires to color the hair, the contents of the tube of FIG. 6C are combined with the contents of the aqueous peroxide composition 24 of FIG. 6B by, preferably, expressing the contents of the tube of FIG. 6C into the container 23 used to contain the aqueous oxidizing peroxide composition 24. The mixture is mixed well by shaking and applied to the hair for the amount of time necessary to oxidatively color the hair. The time period may range from about 5 to 45 minutes. Thereafter, the mixture is rinsed from the hair.

Figure 6E:
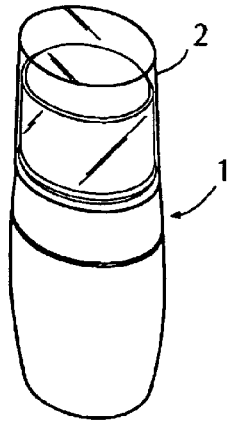
FIG. 6E shows the hair color touch up component which is used to touch up new hair growth or faded hair strands after the hair has been oxidatively colored using the other components of the kit.
Figure 6D:
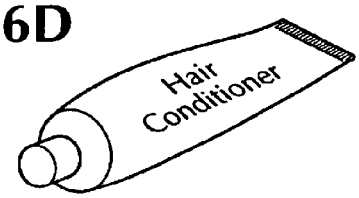
FIG. 6D shows the optional hair conditioner composition.

If the kit contains hair conditioner as depicted in FIG. 6D, the hair conditioner may be applied to the hair to condition it.

The hair color touch up depicted in FIG. 6E is retained. At a later period, after the consumer notices new hair growth or color fading on the oxidatively colored hair, the consumer uses the container depicted in FIG. 6E, which contains a semi-permanent hair color that is identical or similar in shade to the oxidative dye that was in the kit. The touch up is used to touch up new hair growth or faded hair strands. The consumer may simply apply the dye composition found in the FIG. 6E container to the desired strands of dry hair, wait an appropriate period of time, generally about 5 to 30 minutes, but more preferably about 10 minutes. The consumer then rinses the semi-permanent hair color from the hair with water. The faded hair strands and new hair growth are colored to the same color as the originally oxidatively colored hair.

The packaged hair color composition, kit, and method of the invention provides a means for consumers who oxidatively color their hair to touch up the hair between coloring procedures. This enables consumers to maintain their hair color longer, and accordingly reduce the period of time between oxidative coloring procedures. The end result is hair that looks salon quality colored at al times.

EXAMPLE 1

Hair color compositions suitable for use in the packaged hair color composition of the invention are set forth below:

| Ingredient (%) | Medium Brown | Light Auburn | Dark Brown/ Black |
|---|---|---|---|
| Water | 70.85 | 73.294 | 69.145 |
| Ethoxydiglycol | 5.00 | 5.00 | 5.00 |
| Methylparaben | 0.20 | 0.20 | 0.20 |
| Disodium EDTA | 0.05 | 0.05 | 0.05 |
| Aminomethyl propanol | 3.60 | 3.60 | — |
| Monoethanolamine | — | — | 3.60 |
| Erythorbic acid | 0.06 | 0.06 | 0.06 |
| HC Yellow #2 | 0.43 | 0.126 | 0.86 |
| HC Yellow #4 | 0.43 | 0.33 | 0.805 |
| HC Red #3 | 0.15 | 0.28 | 0.10 |
| HC Blue CP | 1.97 | — | 1.97 |
| HC Red 13 | 0.30 | — | 0.25 |
| Disperse Orange #3 | — | 0.60 | — |
| HC Violet 1,3 bis | — | — | 1.00 |
| Veegum | 1.00 | 0.50 | 1.00 |
| Oleic acid | 9.38 | 9.38 | 9.38 |
| Cetearyl alcohol | 3.00 | 3.00 | 3.00 |
| Polawax | 1.50 | 1.50 | 1.50 |
| Oleth-20 | 0.75 | 0.75 | 0.75 |
| Steareth-21 | 0.53 | 0.53 | 0.53 |
| Oleyl alcohol | 0.30 | 0.30 | 0.30 |
| Fragrance | 0.50 | 0.50 | 0.50 |

The compositions were prepared by first heating the water in a kettle having a homogenizer mill attached, to a temperature of about 70 to 75° C. The mill was then turned on and the magnesium aluminum silicate sprinkled in and mixed well for 15–30 minutes. After the magnesium aluminum silicate was hydrated, the mill was turned off. While maintaining the temperature, the ethoxydiglycol, disodium EDTA, erythorbic acid, and methyl paraben were added to the main beaker and mixed for 15 minutes. The dyes were then added. In a side kettle the aminomethylpropanol and monoethanolamine were mixed with a small amount of the water. This pre-mix was then added to the ingredients in the main kettle and mixed for 30 minutes to ensure that the dyes were completely solubilized. The mill was turned off and the batch transferred to a turbine/sweep kettle. The batch was cooled to 35–40° C. and the fragrance oil added. The mixture was further mixed for an additional 15 minutes and cooled to 28–32° C.

Separately, the oil ingredients—oleic acid, cetearyl alcohol, emulsifying wax, oleth-20, oleyl alcohol, and steareth-21—were combined and heated to 70–75° C. The oil phase was then combined with the other ingredients and mixed well while maintaining the temperature at 70–75° C. The batch was cooled to 35–40° C. The fragrance oil was added and the composition mixed for an additional 15 minutes. The batch was cooled to 25° C.

While the invention has been described in connection with the preferred embodiment, it is not intended to limit the scope of the invention to the particular form set forth but, on the contrary, it is intended to cover such alternatives, modifications, and equivalents as may be included within the spirit and scope of the invention as defined by the appended claims.

We claim:

1. A kit for oxidatively coloring hair and touching up the hair color comprising, (a) a first receptacle for containing an acqueous oxidizing agent composition, (b) a second receptacle containing an oxidative hair color composition having a certain color, and (c) a third receptacle containing ready to use semi-permanent hair color composition having the same or similar color as the oxidative hair color composition in the second receptacle, wherein the mixture of compositions of(a) and (b) is used to oxidatively color the hair and the composition of (c) is used to touch up faded hair strands or new hair growth in the hair that has been treated with the mixture of compositions (a) and (b).

2. The kit of claim 1 wherein the receptacles (a) (b), and (c) are contained in a storage container.

3. the kit of claim 2 wherein the storage container is a cardboard box.

4. The kit of claim 1 further comprising a fourth receptacle that contains hair conditioner.

5. The kit of claim 1 wherein the composition of (a) is used to touch up faded hair strands or new hair growth from about two to six weeks after the hair has been oxidatively colored.

6. The kit of claim 1 wherein the receptacles (a), (b), and (c) are made from polypropylene.

7. The kit of claim 1 wherein the third receptacle (c) container has a cap and applicator wherein a porous dispensing outlet is found on the cap and applicator.

8. The kit of claim 1 wherein semi-permanent dye composition in third receptacle (c) comprises from about 0.001–20% of a semi-permanent dye selected from the group consisting of direct dyes, disperse dyes, acid dyes, basic dyes, and mixtures thereof; from about 0.001–50% of a surfactant selected from the group consisting of nonionic surfactant, anionic surfactant, and mixtures thereof; and from about 0.1–99.9% of a polar solvent selected from the group consisting of water, monohydric alcohol; dihydric alcohols, polyhydric alcohols, and mixtures thereof; all percentages by weight of the total composition.

9. The kit of claim 1 wherein the third receptacle is a container having a porous dispensing outlet that is operable to express the semi-permanent hair color composition onto the hair to be colored upon contact of the porous dispensing outlet therewith.

10. The kit of claim 9 wherein the porous dispensing outlet is part of a closure that is integral with the container.

11. The kit of claim 10 wherein the closure is rotated to open and close the container.

12. The kit of claim 9 wherein the third receptacle container is a bottle or tube.

13. The kit of claim 9 wherein the third receptacle container is a bottle.

14. The kit of claim 9 wherein the porous dispensing outlet is porous sponge or foam.

15. The kit of claim 14 wherein the third receptacle further comprises a cap and wherein the porous dispensing outlet in the form of a porous sponge or foam is affixed to the cap.

16. The kit of claim 15 wherein the porous dispensing outlet is in the form of a flat planar surface of porous material affixed to the cap in the form of an applicator.

17. The kit of claim 16 wherein the cap has engaging threads that facilitate attachment of the cap to the applicator.

18. The kit of claim 9 wherein the third receptacle further comprises a lid that may be affixed to the container to close it for storage.

19. The kit of claim 9 wherein the hair color is expressed onto the hair to be colored through the porous dispensing outlet by shear stress.

20. The kit of claim 19 wherein the shear stress is applied by squeezing with the fingers.

21. The kit of claim 9 wherein the hair color is expressed onto the hair to be colored through the porous dispensing outlet by inverting the container.

22. The kit of claim 9 where the porous dispensing outlet is an open celled thermoplastic material.

23. The kit of claim 1 wherein the aqueous oxidizing agent composition in first receptacle comprises hydrogen peroxide.

24. The kit of claim 1 wherein receptacles (a), (b), and (c) are made from thermoplastic polymeric materials selected from the group consisting of ABS, polyethylene, polypropylene, or styrene.

25. The kit of claim 1 wherein the third receptacle is a container that contains a cap and applicator in the form of a porous dispensing outlet which is part of a closure that is integral with the container.

26. The kit of claim 25 wherein the closure is rotated to open and close the container.

27. The kit of claim 25 wherein when the closure is open it permits the hair color composition in the container to flow from the container onto the applicator that is in the form of the porous dispensing outlet.

28. The kit of claim 25 further comprising a secondary lid that may be affixed to the container to close it during storage.

29. The kit of claim 1 wherein the third receptacle is a container comprising a cap having a porous dispensing outlet in the form of a flat planar surface of foam affixed to a circular closure with engaging threads that facilitate attachment of the circular closure to the container.

30. The kit of claim 1 wherein the third receptacle is a tube having a porous dispensing outlet in the form of a sponge applicator affixed to the tube.

31. The kit of claim 30 wherein the sponge applicator contains an internal channel that permits flow of the hair color composition from the tube onto the sponge applicator for application to the hair.

32. The kit of claim 1 wherein the semi-permanent hair color in the third receptacle is applied to the hair after the hair has been oxidatively colored with the mixture of compositions (a), and (b).

33. The kit of claim 32 wherein the semi-permanent hair color in the third receptacle is applied to the hair to touch up the hair color from two to six weeks after the hair has been oxidatively colored with the mixture of compositions (a) and (b).

34. The kit of claim 33 wherein the semi-permanent hair color in the third receptacle is applied to touch up faded hair strands.

35. A kit for oxidatively coloring hair and touching up the hair color comprising, (a) a first receptacle for containing an aqueous oxidizing agent composition, (b) a second receptacle containing an oxidative hair color compositions having a certain color, and (c) a third receptacle comprising a container having a porous dispensing outlet, containing a ready to use semi-permanent hair color composition having the same or similar color as the oxidative hair color composition in the second receptacle said porous dispensing outlet being operable to express the semi-permanent hair color onto the hair to be colored upon contact of the porous dispensing outlet therewith; wherein the mixture of compositions of (a) and (b) is used to oxidatively color the hair and the composition of (c) is used to touch up the hair that has been treated with the mixture of compositions (a) and (b).

36. The kit of claim 35 wherein the porous dispensing outlet is in the form of a cap and applicator that is part of a closure that is integral with the container.

37. The kit of claim 36 wherein the closure is rotated to open and close the container.

38. The kit of claim 36 wherein the closure is moved up and down to open and close the container.

39. The kit of claim 35 wherein the semi-permanent hair color composition in the third receptacle container is expressed therefrom by shear stress.

40. The kit of claim 35 wherein the semi-permanent hair color composition in the third receptacle container is expressed therefrom by inversion.

41. The kit of claim 35 wherein the aqueous oxidizing agent composition comprises hydrogen peroxide.

42. The kit of claim 35 wherein the semi-permanent hair color composition in the third receptacle comprises water soluble dyes, water dispersible dyes, or mixtures thereof.

43. The kit of claim 42 wherein the dyes are direct dyes, disperse dyes, acid dyes, basic dyes, direct dyes, or mixtures thereof.

44. The kit of claim 43 wherein the semi-permanent hair color composition comprises at least one water soluble or water dispersible dye, and, in an aqueous medium, at least one additional ingredient selected from surfactants, polar solvents, lipophilic materials, or mixtures thereof.

45. The kit of claim 35 wherein the semi-permanent hair color composition comprises, by weight of the total composition, from about 0.001–20% of at least one water soluble or water dispersible dye, from about 0.001–50% of at least one surfactant which is nonionic, anionic, cationic, amphoteric, or zwitterionic surfactant, and from about 0.1–99% of at least one polar solvent.

46. The kit of claim 35 wherein the mixture of compositions (a) and (b) is used to oxidatively color hair for about 3 to 45 minutes.

47. The kit of claim 46 wherein the mixture of compositions (a) and (b) is removed from the hair by washing with water.

48. The kit of claim 35 wherein the semi-permanent hair color in the third receptacle is applied to the hair after the hair has been oxidatively colored with the mixture of compositions (a) and (b).

49. The kit of claim 48 wherein the semi-permanent hair color in the third receptacle is applied to the hair to touch up the hair color from two to six weeks after the hair has been oxidatively colored with the mixture of compositions (a) and (b).

50. The kit of claim 49 wherein the semi-permanent hair color in the third receptacle is applied to touch up faded hair strands or new hair growth.

* * * * *